United States Patent [19]

Bursk

[11] Patent Number: 4,644,696

[45] Date of Patent: Feb. 24, 1987

[54] PATIO DOOR ASSEMBLY FOR REMOVABLE ASTRAGAL

[75] Inventor: William M. Bursk, Middletown, Ohio

[73] Assignee: Pease Industries, Inc., Fairfield, Ohio

[21] Appl. No.: 875,819

[22] Filed: Jun. 18, 1986

[51] Int. Cl.[4] ..... E05C 7/04

[52] U.S. Cl. ..... 49/367; 49/365; 49/368; 49/394

[58] Field of Search ..... 49/365, 366, 370, 394

[56] References Cited

U.S. PATENT DOCUMENTS

| | | | |
|---|---|---|---|
| 3,319,382 | 5/1967 | Hand | 49/365 X |
| 3,649,060 | 3/1972 | Ruff | 49/368 X |
| 3,919,808 | 11/1975 | Simmons | 49/367 |
| 4,058,332 | 11/1977 | DiFazio | 49/368 X |

*Primary Examiner*—K. Downey

*Attorney, Agent, or Firm*—Biebel, French & Nauman

[57] ABSTRACT

A double door installation includes an astragal which is removably mounted in the head jamb and sill portions of the door frame independently of the doors, but the combination includes a locking mechanism in one door which incorporates a bolt arranged to project through the astragal into the other door to effect firm locking of both doors to each other and to the astragal.

10 Claims, 10 Drawing Figures

PATIO DOOR ASSEMBLY FOR REMOVABLE ASTRAGAL

FIELD OF THE INVENTION

This invention relates to double door installations for residential use between the interior of the house and a terrace or patio.

BACKGROUND OF THE INVENTION

As pointed out in my U.S. Pat. No. 4,052,819, it is common in double door installations where one of the doors is normally inactive to use a T-shaped astragal mounted on the vertical edge of the inactive door, in such manner that one side of the head of the T overlaps and seals the outside front edge of the inactive door, and the other side of the head portion of the T extends into the swinging path of the active door so as to act as a stop and weather seal when the active door is closed. The invention of my prior patent was directed to providing a double door astragal assembly of that type which could be adjusted into sealing engagement with the front surfaces of both doors independently and irrespective of misalignment of the doors.

It is also conventional—particularly in commercial installations involving relatively heavy double doors—to provide an astragal which is mounted in the top and bottom of the door frame independently of the doors, and which will therefore stand alone in the doorway when both doors are opened. If the installation is one wherein the entire doorway may be needed on some occasions, for passage therethrough of something too wide for a single doorway, provision has been conventionally made for temporarily removing the astragal, by the release of bolts, screws or similar semi-permanent mounting means.

SUMMARY OF THE INVENTION

The present invention has as its primary objective the provision of a double door installation particularly adapted for residential use which will offer the following advantages:

1. The installation includes an astragal which is separate from both doors and has its own mounting in the head jamb and sill.
2. Each door latches to the astragal independently of the other door and can be opened independently of the other door.
3. Either door can be the primary access door, as determined at the time of installation.
4. The primary access door is provided with a dead bolt lock which extends through the astragal into the other door for increased security.
5. The less active door can be directly locked to the astragal without affecting locking and unlocking of the primary access door.
6. Whenever it is desired to use the full width of the doorway, the astragal can be removed as quickly and easily as the primary access door can be opened, leaving the other door equally freely openable.
7. The installation may be provided with a screen door which is slidably mounted to cover either door opening, and which will seal against the frame and the astragal in either of its limit positions.

Other objects and advantages, and the means by which the invention accomplishes them, are pointed out hereinafter in connection with the Description of the Preferred Embodiment.

DESCRIPTION OF THE PREFERRED EMBODIMENT

Figure 1:
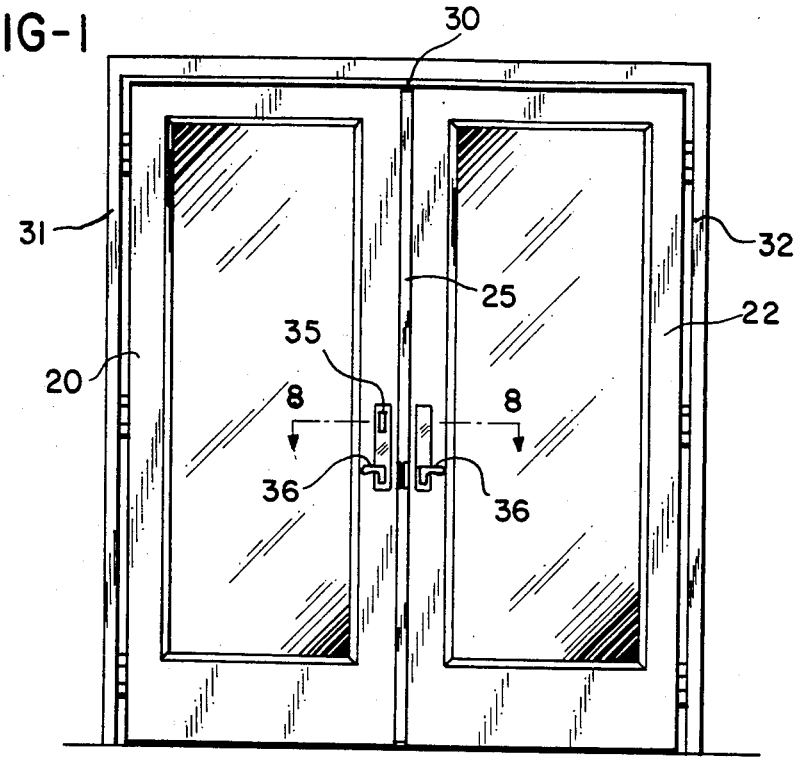
FIG. 1 is an elevational view of a double door installation in accordance with the invention with both doors closed.
Figure 2:
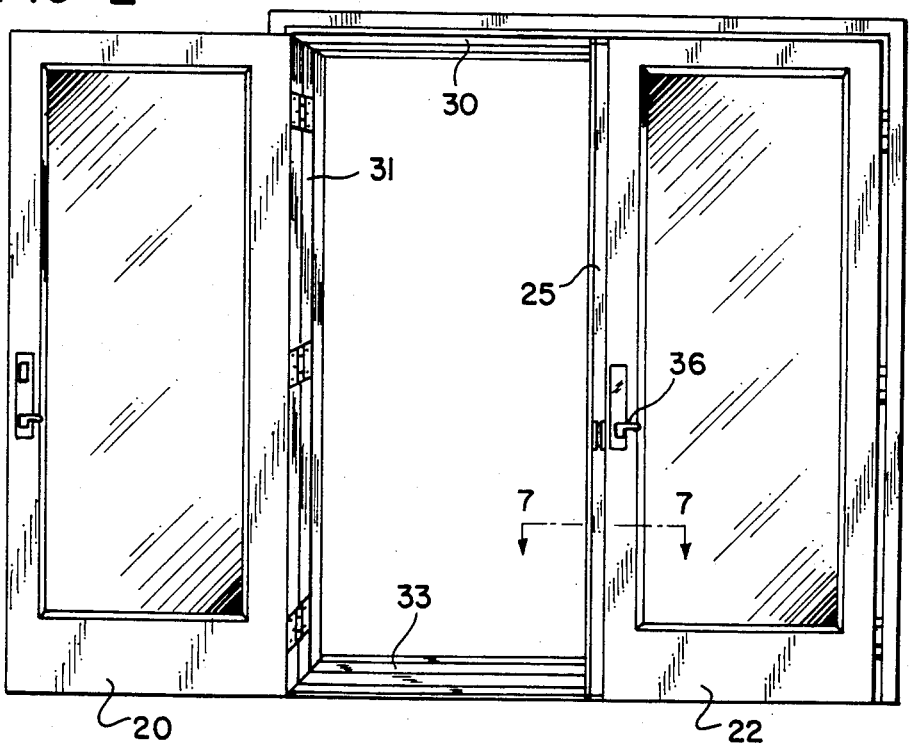
FIG. 2 is a similar view showing one door open.
Figure 3:
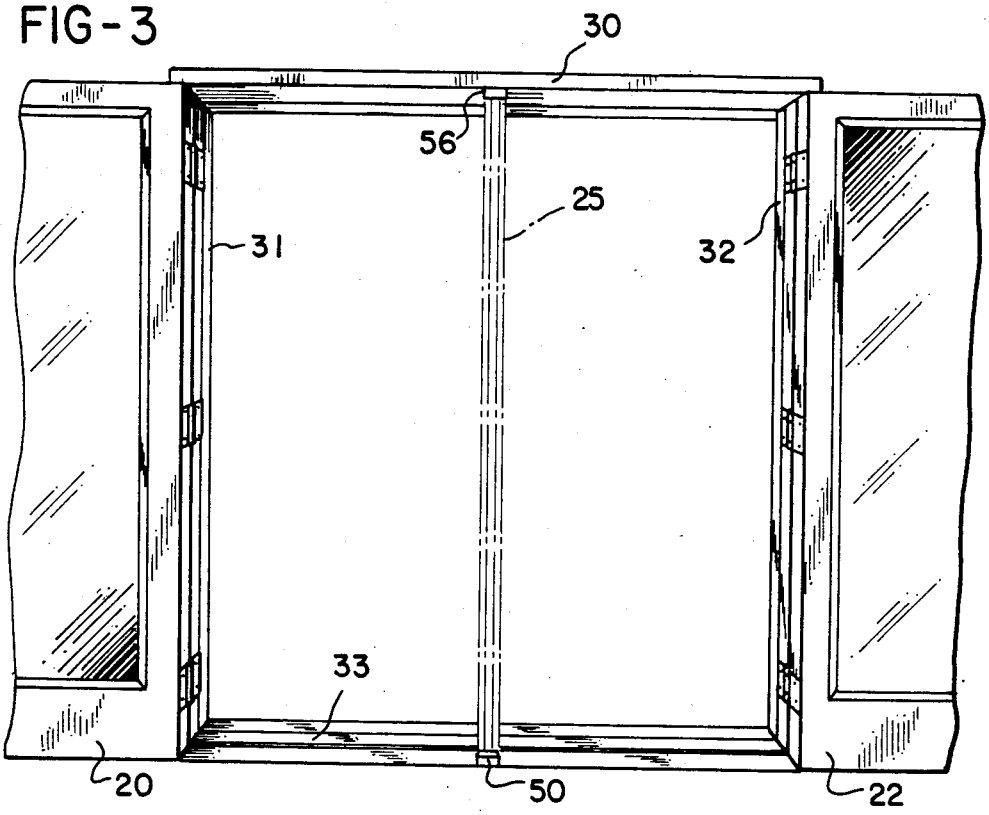
FIG. 3 is a similar view showing both doors open and the astragal removed.
Figure 4:
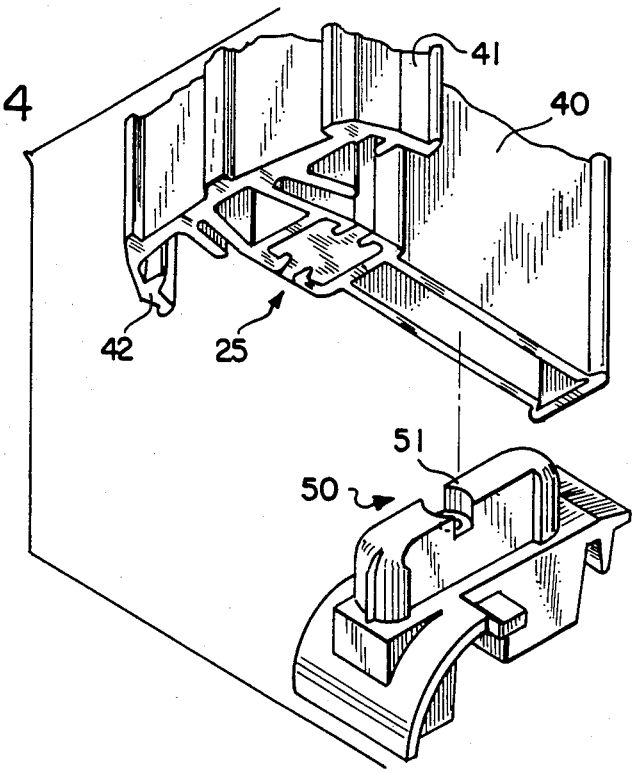
FIG. 4 is a somewhat diagrammatic fragmentary perspective view illustrating the connection between the bottom end of the astragal and the sill.

In the installation illustrated in FIGS. 1–3, doors 20 and 22 and astragal 25 are mounted in a conventional door frame comprising a head jamb 30, side or hinge jambs 31 and 32 and a sill assembly 33, which together define the rectangular opening in which the doors are mounted by the usual hinged connections to the two side jambs. The left-hand door 20 is shown as the primary access door, as indicated by the handle 35 thereon which operates the dead bolt latch as described hereinafter. In addition, each door is provided with an operating handle 36 for a conventional latch mechanism which enables it to be opened independently of the other door when neither door is locked to the astragal.

FIG. 2 illustrates that when only the primary access door 20 is open, the astragal 25 remains in place, and the other door 22 is latched, and may also be locked, thereto. Both doors can be opened without removing the astragal, as indicated by phantom lines in FIG. 3, but it is a feature of the invention that the astragal is quickly and easily removable to leave the entire doorway open, as also illustrated in FIG. 3.

Referring now to FIGS. 4–7, the astragal 25 has a generally T-shaped configuration in horizontal section with the stem 40 of the T being proportioned to fill the space between the two doors 20–22 in their closed positions. The head of the T is normally on the outer side of the doorway and provides arms 41–42 which define stops establishing the closed positions of the two doors which open inwardly of the doorway. The slots 43 receive and hold the barbed mounting portions of magnetic or compression weather strip 44, and the portion 45 of the astragal is a plastic thermal break connection between the metal head and stem portions of the T.

The mounting for the astragal 25 in the door frame includes a sill anchor 50 which is fixed on the sill 33 and is provided with a vertical projection 51 that fits in complementary relation within the hollow lower end of the stem portion 40 of the astragal. At its upper end, the astragal is releasably secured to the head jamb 30 by a latch assembly indicated generally at 55 and an anchor 56 of generally inverted cup shape which is set in a complementary recess in the head jamb 30 and functions as a keeper for the flush bolt 60, which is mounted for vertical sliding movement in the hollow upper end of the astragal stem portion 40.

Figure 5:
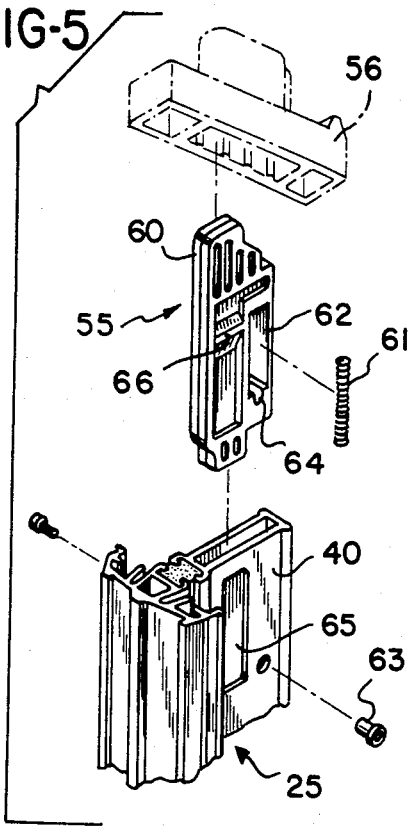
FIG. 5 is a view similar to FIG. 4 showing the releasable connection between the top end of the astragal and the head jamb.
Figure 6:
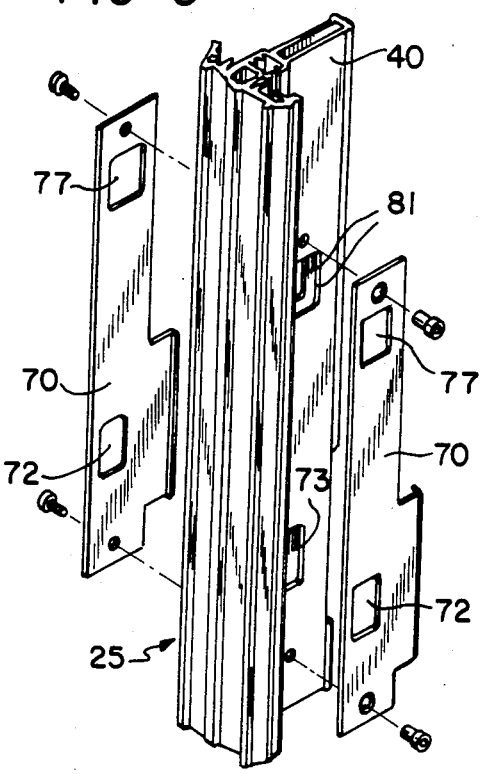
FIG. 6 is a view similar to FIG. 4 illustrating the lock portion of the astragal.

As shown in FIG. 5, the flush bolt 60 is biased upwardly—so that its upper end normally projects above the top of the astragal—by a compression spring 61 received in a slot 62 in the body of the flush bolt 60 and supported at its lower end by a binding post 63 which extends across the astragal stem 40 and is received in a groove 64 at the bottom of the slot 62 to establish the upper limit position of flush bolt 60. A slot 65 in each side of the astragal stem 40 provides access to a handle portion 66 of the flush bolt so that it can be pulled down against the spring 61 to retract it from within the anchor 56 when the astragal is to be removed from the door frame.

In an alternative construction at the lower end of the astragal 25, it may be provided with a second flush bolt assembly mating with a second anchor 56 set in the sill 33. In this case the flush bolt need not be slidable in the astragal but may be fixed thereto with its operative end projecting beyond the astragal for insertion in its complementary anchor in the sill.

Figure 7:
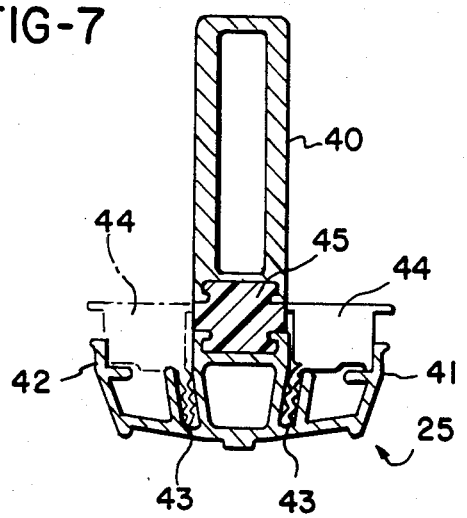
FIG. 7 is an enlarged fragmentary section on the line 7—7 in FIG. 2.
Figure 9:
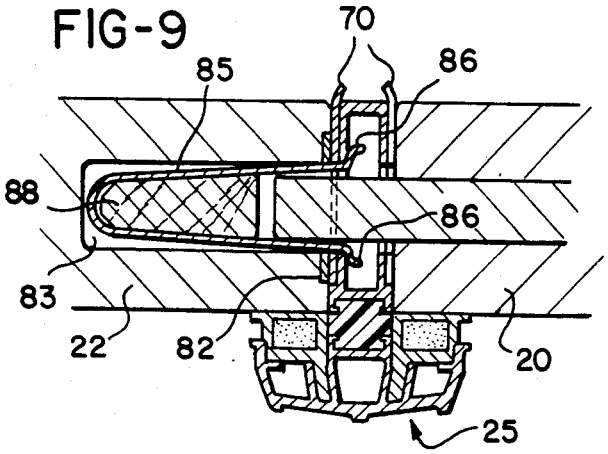
FIG. 9 is a fragmentary perspective view, partly in phantom, further illustrating the dead bolt locking mechanism.

Strike plates 70 of opposite hand are mounted on the opposed sides of the astragal stem portion 40 and include the usual keeper openings 72 which are aligned with similar openings 73 in the sides of the astragal portion 40 for receiving the latch members 75 operated by the handles 36 on the two doors. Both strike plates 70 are also provided with keeper openings 77 for the dead bolt 80, which in the illustrated embodiment is carried by the left-hand door 20. As shown in FIG. 7, the proportions of the parts should be such that if the dead bolt assembly is of a conventional type providing one inch of throw for the dead bolt 80, then in its locking position, the dead bolt will extend completely through the holes 81 in the astragal which are aligned with the strike plate openings 77, and also through the strike plate 82 in the edge of door 22, so that both doors will be locked together and to the astragal.

With the construction as described thus far, release of the dead bolt will allow each of the two doors to be opened independently of the other, by operation of their latch handles 36. Accordingly, provision is made by the invention for independently locking the less active door 22 to the astragal—by means which cannot be released except by removal of the astragal assembly from the door frame, as now described.

Figure 8:
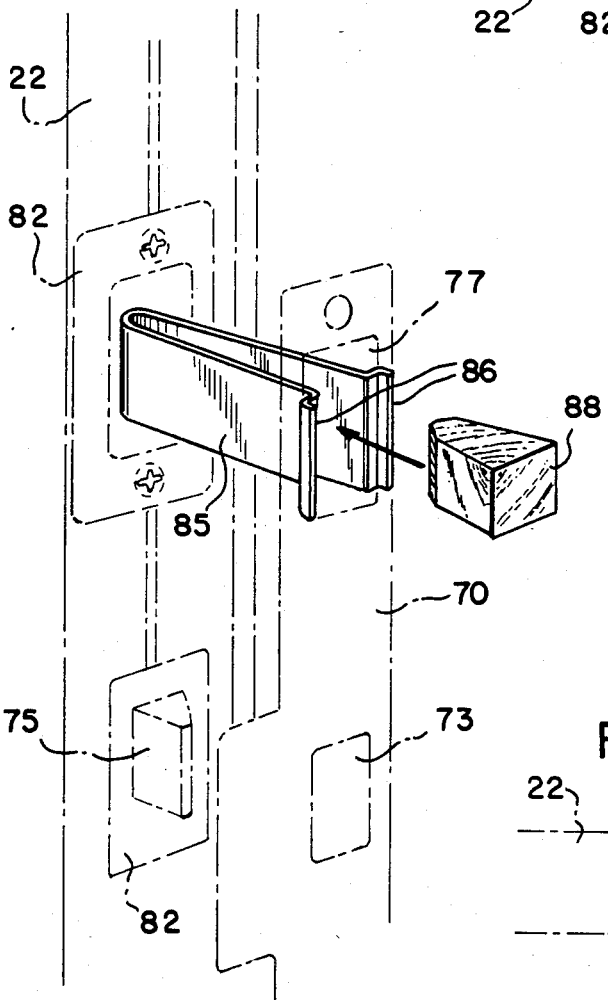
FIG. 8 is an enlarged fragmentary section on the line 8—8 in FIG. 1 showing the dead bolt mechanism for locking both doors together and to the astragal.

Referring to FIGS. 7 and 8, before the strike plate 82 is mounted on the edge of the less active door 22, a bore 83 is drilled in the door which is of sufficient diameter and depth, e.g. 1 inch by 1½ inches, to receive a U-shaped member 85 of resilient metal strap material which serves both as a dead bolt for door 22 and a keeper for the dead bolt 80 carried by door 20. This member 85 has outwardly turned flanges 86 on its ends, and in its normal, unstressed condition, its two outer ends will be spaced further apart than the width of the keeper openings 81 in the astragal.

The member 85 is mounted in position when the door 22 is closed, by pressing its two ends together sufficiently to insert it completely through the opening 77 on the strike plate 70 for door 20 until it snaps in place with its shoulders 86 inside the astragal portion 40. This installation is completed by inserting a filler block 88 of wood or other suitable material and of solid U-shape into the interior of the member 85 inside the bore 83.

The length of the block 88 is such that when it is fully inserted inside the member 85, there will be adequate room in the outer end of the bore 82 to receive the dead bolt 80, and the member 85 will therefore serve as a keeper for the dead bolt. However, the width and thickness of block 88 are such that when the dead bolt is released in order to open door 20, the member 85 will continue to act as a dead bolt connection between door 22 and the astragal, with the block 88 preventing the member 85 from being compressed sufficiently to withdraw its shoulder portions 86 from inside the astragal, even if an attempt is made to pull door 22 open.

Accordingly, once the member 85 and block 88 are in place, the door 22 can be opened only by first removing the astragal assembly, following release of the flush bolt 60 from its anchor 56, since as the astragal is then removed sidewise it will withdraw members 85 and 88 from bore 82. The locked condition of door 22 can be readily reestablished by repeating the installation of members 85 and 88.

As previously noted, either of the two doors 20 and 22 can be established as the primary access door, and this does not have to be determined until after the doors have been installed. Selection must then be made of the appropriate latch assembly in accordance with whether the left or right-hand door will carry the dead bolt mechanism. Thereafter, the less active door will simply remain closed, and cannot be opened without first removing the astragal assembly as described. However, the provision of the simple latch assembly 55 at the head of the astragal makes its removal no more difficult or time consuming than opening of the door itself. Also, if it is desired to use both doors alternatively, the member 85 can be set aside, and each door can then be opened or latched by its own bundle 36 and latch 75.

It is conventional in double door installations of the illustrated type to provide a screen door which is mounted for sliding movement in the frame 30–33 between limit positions at each end of the frame. The invention promotes such installation and use of a screen door, and also insures that it is in properly sealed relation with the astragal and one of the side jambs 31–32 in each of its limit positions.

Figure 10:
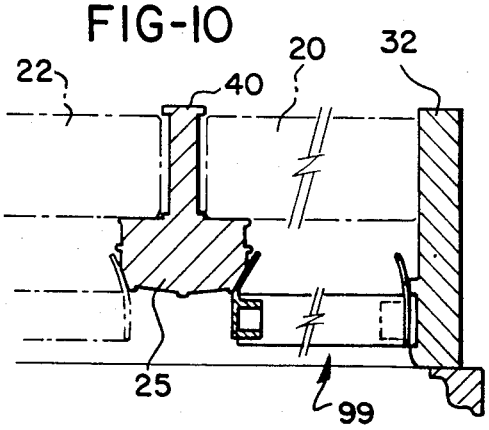
FIG. 10 is a fragmentary view in horizontal section illustrating the provision of the invention for sealing a sliding screen door to the jambs and the astragal.

Referring to FIG. 10, the screen door 99 has its top and bottom mounted for sliding movement in conventional tracks (not shown) in the head jamb 30 and sill 33. A flashing strip 100 is mounted in each side edge of the screen door 99, by means such as the telescoping snap connection 101, with the flashing strip extending inwardly of the door opening.

As shown in FIG. 10, when the screen door 99 is in its limit position at the left-hand side of the frame and covering the opening for the left-hand door 20, one flashing strip 100 will seal against the jamb 31, while at the same time, the flashing strip 100 on its other side will seal against the arm portion 41 of the astragal. Similarly at its other limit position, the flashing strips 100 will seal against the jamb 32 and the arm portion 42 of the astragal. It will therefore now be seen that if desired for ventilation purposes, the keeper assembly 85–88 can be removed to permit door 22 to be opened, and to remain open, with the screen door 99 aligned with its opening, while the door 20 continues to be used as the primary access door without the necessity of opening and closing the screen door.

While the product and method herein described constitute preferred embodiments of the invention, it is to be understood that the invention is not limited to this precise product and method, and that changes may be made therein without departing from the scope of the invention which is defined in the appended claims.

What is claimed is:

1. In a double door installation including head and side jambs and a sill defining a rectangular door frame and a pair of doors mounted on said side jambs to swing to and from closed positions in line with each other, said doors being proportioned to leave a space of predetermined width therebetween in said closed positions, the combination of (a) an astragal of generally T-shape in horizontal section providing arm portions defining stops establishing said closed positions of said doors and a stem portion proportioned to be received in said space between said closed doors, (b) means for removably attaching said astragal to the top and bottom of said door frame, (c) locking means in one of said doors including a horizontally movable dead bolt, (d) means defining a keeper recess for said dead bolt in the other of said doors and in line with said dead bolt, and (e) said astragal having an opening therethrough aligned with said dead bolt and said keeper recess whereby said dead bolt will extend through said astragal into said keeper recess to lock both of said doors to each other and to said astragal.

2. The combination defined in claim 1 further comprising supplemental latch means receivable in said keeper recess to lock said other door to said astragal, said supplemental latch means having a recess in the outer end thereof for receiving and keeping said dead bolt in the locked position of said one door.

3. The combination defined in claim 2 wherein said stem portion of said astragal is provided with a hollow space aligned with said dead bolt and said keeper recess, and said supplemental latch means is proportioned to be retained partly within said space and partly within said keeper recess to prevent release thereof except by first removing said astragal from said door frame.

4. The combination defined in claim 3 wherein said supplemental latch means is a U-shaped member of resilient material having the closed end thereof received in said keeper recess with the open end thereof within said hollow space in said astragal to receive said dead bolt, the ends of said V-shaped member having outwardly projecting shoulders adapted to hook around opposed edges of the adjacent said opening into said hollow space within said astragal.

5. The combination defined in claim 4 further comprising filler means received in said supplemental latch means within said keeper recess to prevent sufficient compression of said supplemental latch means for release of said shoulders from said adjacent opening into said astragal and thereby to prevent withdrawal of said member except after from said keeper recess by removal of said astragal from said door frame.

6. The combination defined in claim 2 further comprising handle-operated latch means in each of said doors, and keeper means in said astragal for each of said latch means.

7. The combination defined in claim 3 further comprising handle-operated latch means in each of said doors, and keeper means in said astragal for each of said latch means, whereby each of said doors can be opened and closed independently of the other following release of said supplemental latch means and replacement of said astragal.

8. The combination defined in claim 3 further comprising spring biased bolt means in one end of said astragal for releasably latching said astragal end to the adjacent portion of said door frame.

9. The combination defined in claim 3 further comprising complementary interfitting means on said sill and the bottom end of said astragal for releasably anchoring said astragal to said sill, keeper means in said head jamb, and spring biased latch means in the upper end of said astragal for cooperation with said keeper means to provide a readily releasable connection between said astragal and said head jamb.

10. The combination defined in claim 1 further comprising:

(a) track means in said head jamb and sill, (b) a screen door of substantially the same dimensions as one of said doors received for sliding movement in said track means between limit positions at opposite ends of said door frame, and (c) flexible flashing means mounted on each side of said screen door for yieldable sealing engagement with said astragal and one of said jambs in each of said limit positions of said screen door.

* * * * *

UNITED STATES PATENT AND TRADEMARK OFFICE

CERTIFICATE OF CORRECTION

PATENT NO. : 4,644,696

DATED : February 24, 1987

INVENTOR(S) : William M. Bursk

It is certified that error appears in the above-identified patent and that said Letters Patent is hereby corrected as shown below:

IN THE TITLE: (Both Instances)

"PATIO DOOR ASSEMBLY FOR REMOVABLE ASTRAGAL" should be --PATIO DOOR ASSEMBLY WITH REMOVABLE ASTRAGAL--.

Column 1, lines 27 and 28, "door-s-to" should be --doors - to--.

Signed and Sealed this

Eighth Day of September, 1987

*Attest:*

DONALD J. QUIGG

*Attesting Officer*

*Commissioner of Patents and Trademarks*